US005285652A

United States Patent [19]

Day

[11] Patent Number: 5,285,652

[45] Date of Patent: Feb. 15, 1994

[54] SENSOR FOR PRESSURE CONTROLLED SWITCHING VALVE FOR REFRIGERATION SYSTEM

[75] Inventor: James Day, Scotia, N.Y.

[73] Assignee: General Electric Company, Schenectady, N.Y.

[21] Appl. No.: 43,691

[22] Filed: Apr. 8, 1993

[51] Int. Cl.[5] ..... F25B 5/00; H01H 35/40

[52] U.S. Cl. ..... 62/199; 62/524; 200/82 E; 200/83 A

[58] Field of Search ..... 62/199, 117, 524; 200/83 A, 82 R, 82 E

[56] References Cited

U.S. PATENT DOCUMENTS

| | | | |
|---|---|---|---|
| 2,182,318 | 12/1939 | Newill | 62/525 |
| 3,550,613 | 12/1970 | Barber | 200/83 A |
| 4,680,436 | 7/1987 | Brausfeld et al. | 200/82 E |
| 5,156,016 | 10/1992 | Day | 62/199 |
| 5,184,473 | 2/1993 | Day | 62/199 |

OTHER PUBLICATIONS

U.S. patent application Ser. No. 07/612,290, filed Nov. 9, 1990, allowed Feb. 3, 1993, Batch No. K08 now U.S. Pat. No. 5,228,308.

*Primary Examiner*—William E. Wayner
*Attorney, Agent, or Firm*—William H. Pittman

[57] ABSTRACT

A refrigerant flow switching device for alternately conveying refrigerant from a high pressure and a low pressure evaporator to a compressor of a refrigeration system, and a refrigerator using such a refrigeration system, includes a refrigerant flow switching valve for alternately conveying refrigerant from the high and low pressure evaporators to the compressor. Said switching valve is controlled by a pressure switch that utilizes the pressure difference between the refrigerant from the high pressure evaporator and that from the low pressure evaporator to cyclically open or close a switch assembly, moving the switch between low and high pressure positions.

17 Claims, 4 Drawing Sheets

SENSOR FOR PRESSURE CONTROLLED SWITCHING VALVE FOR REFRIGERATION SYSTEM

CROSS REFERENCE TO RELATED APPLICATION

This application is related to commonly assigned application Ser. No. 07/612,290, now U.S. Pat. No. 5,228,308, incorporated herein by reference.

FIELD OF THE INVENTION

The present invention generally relates to refrigeration systems, and more particularly to sensors also known as pressure switches used in refrigeration systems with multiple evaporators having pressure controlled autonomous switching valves for conveying refrigerant from said evaporators to a compressor unit.

BACKGROUND OF THE INVENTION

In a typical refrigeration system, refrigerant circulates continuously through a closed circuit. The term "circuit", as used herein, refers to a physical apparatus whereas the term "cycle" as used herein refers to operation of a circuit, e.g., refrigerant cycles in a refrigeration circuit. The term "refrigerant", as used herein, refers to refrigerant in liquid, vapor and/or gas form. Components of the closed circuit cause the refrigerant to undergo temperature/pressure changes which result in energy transfer. Typical components of a refrigeration system include, for example, compressors, condensers, evaporators, control valves, and connecting piping.

Energy efficiency is an important factor in the assessment of refrigeration systems. Increased energy efficiency is typically achieved by utilizing more expensive and more efficient components, by adding extra insulation adjacent to the area to be refrigerated, or by other costly additions. Increasing the energy efficiency of a refrigeration system therefore usually results in an increase in the cost of the system. It is, therefore, desirable to increase the efficiency of a refrigeration system and minimize any increase in the cost of the system.

In some apparatus utilizing refrigeration systems, more than one area needs to be refrigerated, and at least one area requires more refrigeration than another area. A typical household refrigerator, which includes a freezer compartment and a fresh food compartment, is one example of such an apparatus. The freezer compartment is preferably maintained between about −25° and about −10° C., and the fresh food compartment between about +1° and about +8°·C.

To meet these temperature requirements, a typical refrigeration system includes a compressor coupled to an evaporator. The terms "coupled" and "connected" are used herein interchangeably. When two components are coupled or connected, this means that the components are linked, directly or indirectly in some manner in refrigerant flow relationship, even though another component or components may be positioned between them.

Referring again to the refrigeration system for a typical household refrigerator, the evaporator is maintained at about −25° C. (an actual range of about −15° to −35° C. is typically used) and air is blown across the coils of the evaporator. The flow of the evaporator-cooled air is controlled, for example, by barriers. A first portion of the evaporator-cooled air is directed to the freezer compartment and a second portion to the fresh food compartment.

To cool a fresh food compartment, it is also possible to utilize an evaporator operating at, for example, about −5° C. (or in a range from about −10° C. to about 0° C.). A typical refrigeration system utilized in household refrigerators, therefore, produces its refrigeration effect by operating the evaporator at a temperature which is appropriate for the freezer compartment but lower than it needs to be for the fresh food compartment. A typical household refrigerator therefore uses more energy to cool the fresh food compartment than is necessary, operating at reduced energy efficiency.

This household refrigerator example is provided for illustrative purposes only. Many apparatus other than household refrigerators utilize refrigeration systems which include an evaporator operating at an unnecessarily low temperature.

A refrigeration system which operates at reduced energy consumption is described in U.S. Pat. No. 5,156,016. It utilizes at least two evaporators and a plurality of compressors or a compressor having a plurality of stages. This device utilizes the pressure difference between the high pressure and the low pressure refrigerant to operate a switching valve having bellows therein. However, for refrigeration systems that operate at 25 kg./cm.$^2$ and are required to be functional without rupture at 100 kg./cm.$^2$ or greater, the cost of such a valve is quite high. A need exists for a less expensive and equally efficient refrigeration system to function under such conditions.

STATEMENT OF THE INVENTION

The present invention is directed to a flow switching device for alternately conveying refrigerant from high or low pressure evaporator means to compressor means of a refrigeration system, said device comprising:

a switching valve adapted to move between a low and high pressure position allowing said refrigerant to flow alternately and respectively from said low and high pressure evaporator means to said compressor means; and a pressure switch between said high pressure evaporator means and said low pressure evaporator means, said pressure switch connected to said switching valve and adapted to move said switching valve between said low and high pressure positions and comprising:

a piston housing positioned in a refrigerant flow relationship between said high and low pressure evaporator means, said housing being divided into a first portion and a second portion by a ferrous metal piston slidably positioned therein;

a rocker arm chamber positioned in a slidable relationship with said piston housing and having first and second magnetized junctions mounted on a rocker arm; and a switch assembly electrically connected to said switching valve such that when said piston is in a first position said switch assembly is opened and moves said switching valve to said low pressure position, and when said piston is in a second position said switch assembly is closed and moves said switching valve to said high pressure position.

The present invention is further directed to a refrigerator comprising compressor means, condenser means connected to receive refrigerant discharged from said compressor means, a fresh food compartment, first evaporator means for refrigerating said fresh food compartment and connected to receive at least part of the refrigerant discharged from the condenser means, a freezer compartment, second evaporator means for refrigerating said freezer compartment and connected to receive at least part of the refrigerant discharged from the condenser means, and a refrigerant flow switching device as defined hereinabove.

The present invention provides increased energy efficiency by utilizing a plurality of evaporators which operate at desired refrigeration temperatures. Further, by utilizing, in one embodiment, a single-stage compressor rather than a plurality of compressors or a compressor having a plurality of stages, the costs associated with improved energy efficiency are minimized.

DETAILED DESCRIPTION OF THE PREFERRED EMBODIMENT

The invention is believed to have its greatest utility in refrigeration systems and particularly in household refrigerator-freezers. However, it also has utility in other refrigeration applications such as for control of multiple air conditioner units. The term "refrigeration system", as used herein, therefore not only refers to refrigerator-freezers but also to other types of refrigeration applications.

Figure 1A:
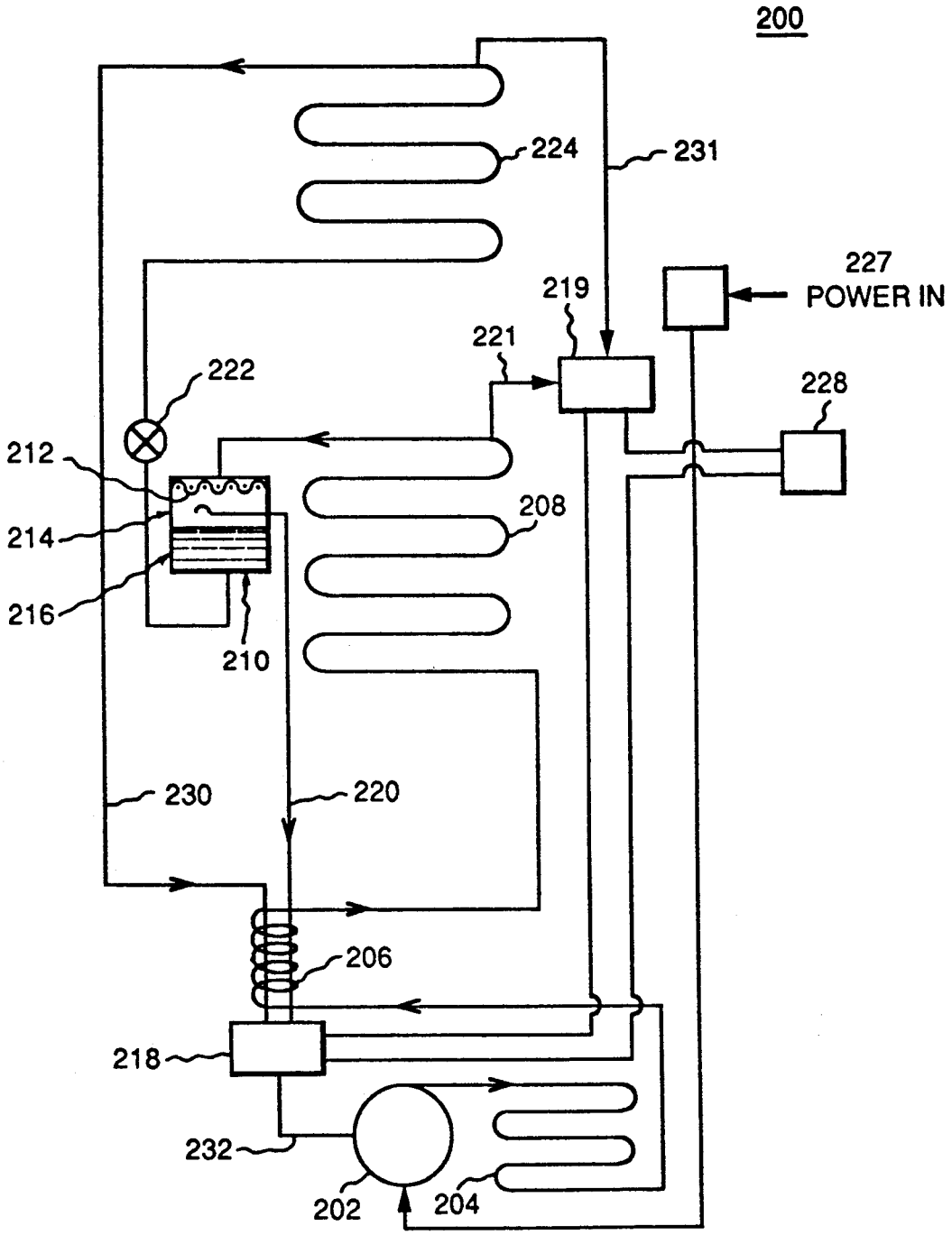
FIG. 1A illustrates a refrigeration system utilizing the refrigerant flow switching device of the preferred embodiment.

Referring now more particularly to the drawings, FIG. 1A illustrates a refrigeration system 200 in accordance with the preferred form of the present invention. It includes a compressor unit 202 coupled to a condenser 204. A capillary tube 206 is coupled to the outlet of condenser 204, and a first evaporator 208, also known as a high pressure evaporator, is coupled to the outlet of capillary tube 206. The outlet of first evaporator 208, also known as a high pressure evaporator, is coupled to the inlet of a phase separator 210, which includes a screen 212 disposed adjacent to the inlet thereof, a gas- or vapor-containing portion 214 and a liquid-containing portion 216. Although sometimes referred to herein as vapor-containing portion 214 or simply as vapor portion 214, it should be understood that this portion of phase separator 210 may have gas and/or vapor disposed therein. Vapor portion 214 is coupled to supply a high pressure refrigerant as a first input via conduit 220 to refrigerant flow switching valve 218, which is preferably operated by an electrically powered solenoid. Particularly, the intake of conduit 220 is so positioned in vapor portion 214 that liquid refrigerant passing through vapor portion 214 to liquid-containing portion 216 does not enter said intake.

The outlet of liquid-containing portion 216 is coupled to expansion device 222 (sometimes referred to herein as a throttle), such as an expansion valve or a capillary tube. A second evaporator 224, also known as a low pressure evaporator, is coupled to the outlet of expansion device 222, and the outlet of second evaporator 224 is coupled to provide a low pressure refrigerant as a second input to refrigerant flow switching valve 218.

A thermostat 227, which is preferably user adjustable, receives current flow from an external power source designated by the legend "POWER IN" and is connected to compressor unit 202. When cooling is required, thermostat 227 provides an output signal which activates compressor unit 202. In a household refrigerator, for example, thermostat 227 is preferably disposed in the freezer compartment.

Capillary tube 206 is in thermal contact with conduit 220 which connects phase separator vapor portion 214 with refrigerant flow switching valve 218, and also in thermal contact with conduit 230 which couples second evaporator 224 to refrigerant flow switching valve 218. Thermal contact is achieved, for example, by soldering the exterior of capillary tube 206 and a portion of the exterior of conduits 220 and 230 together side by side. Capillary tube 206 is shown in FIG. 1A as being wrapped around conduits 220 and 230 in a schematic representation of a heat transfer relationship. The heat transfer occurs in a counterflow arrangement, i.e., the refrigerant flowing in capillary tube 206 proceeds in a direction opposite to the flow of refrigerant in conduits 220 and 230. As is well known in the art, using a counterflow heat exchange arrangement, rather than a heat exchange arrangement wherein the flows proceed in a same direction, increases the heat exchange efficiency.

Pressure switch 219, powered by electrical power source 228, is coupled to conduits 221 and 231 and is also electrically connected to valve 218. Switch 219, actuated by the pressure difference between conduits 221 and 231, provides an electrical signal that triggers valve 218.

In operation, and by way of example, first and second evaporators 208 and 224 contain refrigerant at temperatures of approximately −5° and −25° C., respectively. Expansion device 222, which may be a capillary tube having an appropriate bore size and length or an expansion valve, is adjusted to provide barely superheated vapor flow at the outlet of second evaporator 224.

Switching valve 218 controls the flow of refrigerant passing through respective evaporators 208 and 224 to compressor unit 202. When refrigeration is called for, thermostat 227 activates compressor unit 202. Vapor from second evaporator 224 enters compressor unit 202 when switching valve 218 is configured to allow conduits 230 and 232 to be in flow communication, a situation hereinafter designated STATE 1. Alternatively, vapor from phase separator 210 enters compressor unit 202 when switching valve 218 is configured to allow conduits 220 and 232 to be in flow communication, designated STATE 2. The inlet pressure to compressor unit 202 is about 1.5 kg./cm.$^2$ absolute when switching valve 218 is in STATE 1 and about 3 kg./cm.$^2$ absolute when it is in STATE 2. Transition from one state to another is effectuated by pressure switch 219 as more fully described hereinafter.

Capillary tube 206 is preferably sized to provide some subcooling (i.e., cooling below its saturation temperature) of the liquid exiting condenser 204, as well as metering the flow of refrigerant and maintaining a pressure difference between condenser 204 and first evaporator 208. Further, heat exchange occurs between capillary tube 206 and conduit 220 from phase separator 210, preventing condensation of moisture on conduits 220 and 230 and cooling the refrigerant in capillary tube 206 flowing to first evaporator 208.

Refrigerant in liquid and vapor phases exiting first evaporator 208 enters phase separator 210, with liquid refrigerant accumulating in liquid-containing portion 216 and vapor in vapor portion 214. Conduit 220 supplies vapor from vapor portion 214 to switching valve 218, generally at about −5° C.

When thermostat 227 activates compressor unit 202, valve 218 is in STATE 1, the default state. Liquid from liquid-containing portion 216 of phase separator 210 evaporates as it flows through throttle 222 into and through second evaporator 224. Thus, the temperature and pressure of liquid refrigerant entering second evaporator 224 from throttle 222 significantly drop, further cooling said evaporator to about −25° C. Refrigerant flows, albeit slowly, through first evaporator 208 when valve 218 is in STATE 1. Sufficient refrigerant is typically supplied to system 200 to maintain liquid refrigerant at a desired level in phase separator 210.

The pressure at the input of compressor unit 202 when valve 218 is in STATE 1 is determined by the pressure at which refrigerant exists in a two-phase equilibrium at −25° C. The pressure at compressor unit 202 when valve 218 is in STATE 2 is determined by the saturation pressure of refrigerant at −5° C.

The temperature of condenser 204 has to be greater than ambient for it to function as a condenser. The refrigerant within condenser 204, for example, may be at 40° C. The refrigerant pressure depends, of course, upon the refrigerant selected.

The refrigeration system 200 illustrated in FIG. 1A requires less energy than a single-evaporator system with the same cooling capacity. Some efficiency advantages come about due to the fact that the vapor leaving the higher temperature evaporator 208 is compressed from an intermediate pressure, rather than from the lower pressure of that leaving the lower temperature evaporator 224. Thus, less compression work is required than if all the refrigerant was compressed from the freezer exit pressure.

Figure 1B:
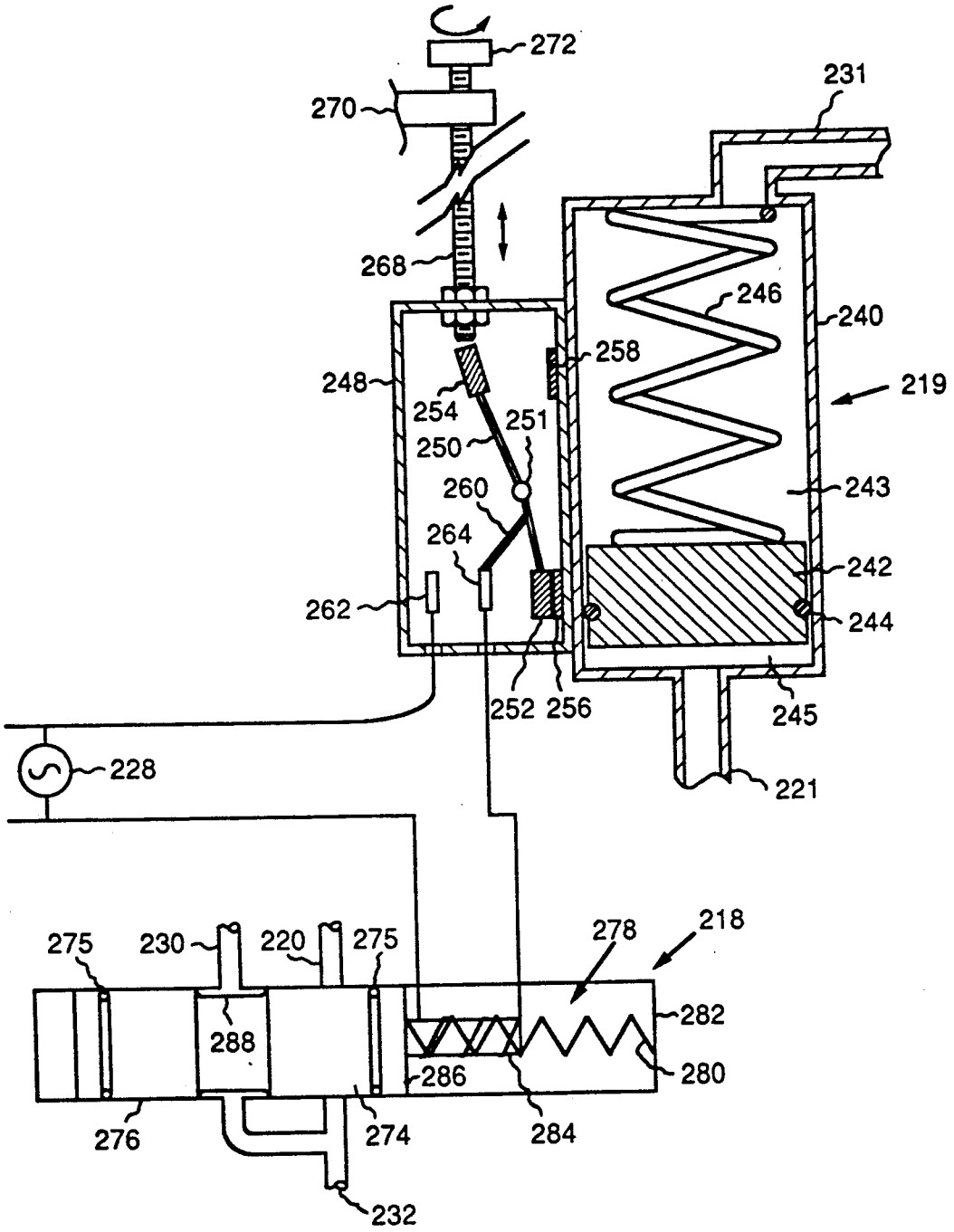
FIG. 1B shows, in more detail, the refrigerant flow switching device included in the refrigeration system of FIG. 1A at a first position (STATE 1).
Figure 1C:
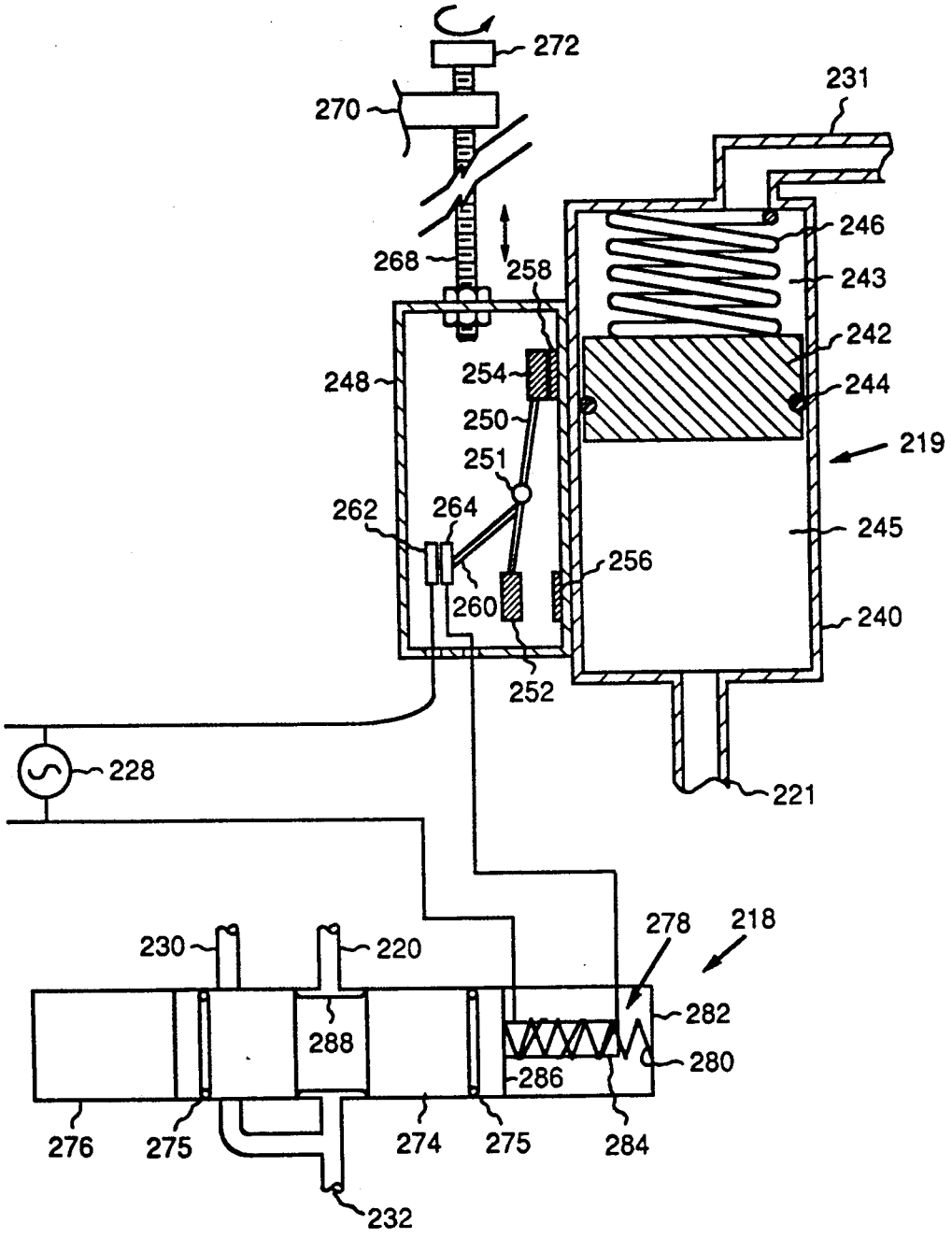
FIG. 1C shows, in more detail, the refrigerant flow switching device included in the refrigeration system of FIG. 1A at a second position (STATE 2).

FIGS. 1B and 1C illustrate, in more detail, a preferred embodiment of the flow switching device of the present invention comprising refrigerant flow switching valve 218 and pressure switch 219. Valve 218 is shown as being integrally formed with conduits 220, 221, 230, 231 and 232. However, valve 218 may alternatively have inlet and outlet conduits which are coupled to conduits 220, 221, 230, 231 and 232 by joining methods, such as welding, soldering, or mechanical coupling. In FIGS. 1B and 1C, valve 218 is shown in STATE 1 and STATE 2, respectively.

FIGS. 1B and 1C show inputs to valve 218 from conduits 220 and 230 and a branched output into conduit 232. Thus, valve 218 can supply refrigerant flow from either conduit 220 or conduit 230 to conduit 232 connected to compressor 202 as shown in FIG. 1A. A cylindrical spool 274 is slidably positioned inside a valve housing 276, with seals being provided by O-rings 275. A solenoid 278 is coupled to spool 274, such that when solenoid 278 is energized it moves spool 274 in valve housing 276. First biasing means, such as a first compression spring 280, is connected at one end 282 to valve housing 276, rides over a solenoid core 284 attached to spool 276 and is connected at the other end 286 to spool 274.

Electrical energy to solenoid 278 is provided by power source 228. Solenoid 278 is energized when stationary switch contact 262 and movable switch contact 264 of a switch assembly of pressure switch 219, hereinafter described, electrically connect to one another, i.e., the switch assembly of pressure switch 219 is closed. Solenoid 278 is deenergized when stationary switching contact 262 is electrically disconnected from movable switching contact 264, i.e., the switch assembly of pressure switch 219 is opened.

In STATE 1 as shown in FIG. 1B, an annular groove 288 of spool 274 permits conduit 230, connected to the inlet of valve 218, to be in refrigerant flow communication with conduit 232 connected to the outlet of valve 218. Solenoid 278 is in a deenergized state as said switch contacts 262 and 264 of the switch assembly of pressure switch 219 are electrically disconnected from one another and first spring 280 in an uncompressed state pushes spool 274 away from end 282 of housing 274.

In STATE 2, as shown in FIG. 1C, annular groove 288 of spool 274 permits conduit 220, connected to the inlet of valve 218, to be in refrigerant flow communication with conduit 232 connected to the outlet of valve 218. Solenoid 278 is in an energized state as switching contacts 262 and 264 are electrically connected to one another, and solenoid core 284 connected to spool 274 pulls it closer to end 282 of housing 274, compressing first spring 280 against end 282 of housing 274.

Timing of the movement of spool 274, shown in FIGS. 1B and 1C, is provided by pressure switch 219, which comprises a cylindrical piston housing 240 connected to conduit 231 at one end and to conduit 221 at the other end. Piston housing 240 is preferably cylindrical in shape and is made from a nonmagnetic material, such as rigid polymer, aluminum, copper, stainless steel or brass. Brass is preferred.

Housing 240 contains slidable piston 242 having a sealable member, such as O-ring 244, mounted in the wall that is in slidable contact with the inner wall of housing 240. Piston 244 is made of magnetic material, such as steel, alloys of iron, nickel or cobalt. Steel is preferred.

Piston 242 divides the inner cavity of housing 240 into two portions, a first portion 243 connected to conduit 231 and a second portion 245 connected to conduit 221. O-ring 244 prevents leakage of refrigerant from first portion 243 to second portion 245.

In STATE 1, shown in FIG. 1B, piston 242 is in a first (default) position and in STATE 2, shown in FIG. 1C, it is in a second position. Second biasing means, such as second compression spring 246, is positioned in first portion 243 of housing 240 with its ends in contact with (as shown) or affixed to the end piece of housing 240 and the top of piston 242. Thus, spring 246 urges piston 242 to the first position when the pressure exerted thereby is greater than that generated in portion 245 of housing 240.

Pressure switch 219 further comprises a rocker arm chamber 248 positioned in slidable relationship with the outer surface of piston housing 240. Chamber 248 preferably has a half moon shaped cross section, such that its concave curvature matches the convex curvature of and is in facially close contact with the outer surface of housing 240.

Adjustment of the timing of energization and deenergization of solenoid 278 is achieved by elongated rotatable member 268, such as a cable or rod, having a threaded portion connected to chamber 248 for sliding said chamber 248 against housing 240 in the direction of the arrows. The threaded portion of elongated member 268 passes through a matching threaded portion on a preferably stationary threaded block 270. Elongated member 268 is further provided with knob 272, which can be manually adjusted by a user. The threaded portion on elongated member 268 is calibrated to match various desired temperatures in the fresh food compartment of the refrigerator. For operator convenience, knob 272 preferably has graduations that match with desired temperatures in said fresh food compartment.

Pressure switch 219 further comprises a rocker arm 250, pivotally mounted on a pivot point 251 inside rocker arm chamber 248 and preferably comprising a rigid elongated member equally divided by said pivot point 251. A first junction 252 and a second junction 254, both permanently magnetized, are affixed to the extremities of rocker arm 250, preferably equidistant from pivot point 251; they are made of any suitable permanently magnetic material. Magnetized steel is preferred.

A first pad 256 and a second pad 258, each of which is a thin piece of magnetic material, are affixed to the wall of rocker arm chamber 248 opposite first junction 252 and second junction 254, respectively, in such a way that when rocker arm 250 rotates in a clockwise direction second junction 254 contacts second pad 258 and when rocker arm 250 rotates in a counterclockwise direction first junction 252 contacts first pad 256. In STATE 1, shown in FIG. 1B, rocker arm 250 is in the open position and in STATE 2, shown in FIG. 1C, it is in the closed position. Thus, when piston 242 is in the first position it magnetically attracts first junction 252 against first pad 256 and when piston 242 is in the second position it magnetically attracts second junction 254 against second pad 258. The magnetic attraction of pads 256 and 258 toward junctions 252 and 254, respectively, prevents accidental movement of rocker arm 250 during the time when piston 242 is in transit between the first and second positions.

Movable switch contact 264 is affixed to an extremity of a switch arm 260, preferably a rigid elongated member, affixed to a leg of rocker arm 250. Contact 262 is positioned in an opposing relationship to movable switch contact 264 such that when first junction 252 of rocker arm 250 is in contact with first pad 256, said contact 262 is disconnected from movable switch contact 264 and when second junction 254 is in contact with second pad 258, said contact 262 is connected to movable switch contact 264. Stationary switch contact 262 and movable switch contact 264 form a switch assembly of an electrical circuit that cyclically energizes and deeergizes solenoid 278 of valve 218.

Contacts 262 and 264 are made of electrically conductive material, such as copper, aluminum, gold, silver or platinum. Copper is preferred. If desired the surfaces of contacts 262 and 264, especially those of copper, may be coated with a gold or platinum layer to prevent surface oxidation due to arcing.

Electrical conductors, such as copper wire, connected to contacts 262 and 264 convey electrical power from power supply 228 to solenoid 278. When stationary switch contact 262 is in contact with movable switch contact 264, solenoid 278 is energized and when stationary switch contact 262 is disconnected from movable switch contact 264, solenoid 278 is deenergized. It should be noted that a magnetic proximity switch with the proper dead band may be used instead of the switch assembly shown in FIGS. 1B and 1C.

In operation, refrigerant pressure at (for example) 3 kg./cm.$^2$ absolute building up within second portion 245 of piston housing 240 starts to push piston 242 from the first position (FIG. 1B) to the second position (FIG. 1C). Piston 242 pushes against the constant force of second compression spring 246 and the low pressure (e.g., about 1.5 kg./cm.$^2$) refrigerant present in conduit 231 as it moves from the first position to the second position. The selection of particular springs, piston, and chamber size of pressure switch 219 is matched to the desired operating characteristics. Rocker arm 250 is kept in the open position by the magnetic force exerted by piston 242 on first junction 252. As switch contacts 262 and 264 are not in contact, the electrical circuit supplying power to solenoid 278 is interrupted and solenoid 278 is deenergized. Thus, spool 274 pushed by first spring 280 allows conduits 230 and 232 to communicate via groove 288.

As piston 242 moves to the second position, shown in FIG. 1C, first pad 256 holds first junction 252 in place while piston 242 is intermediate between the first and second positions. Once piston 242 reaches the second position, it exerts a magnetic pull on second junction 254 which snaps against second pad 258, closing switch contact 264 against stationary contact 262 and thereby completing the electrical circuit that supplies power to solenoid 278. Solenoid 278 is then energized, which forces spool 274 against first spring 280 thereby shifting groove 288 to connect conduits 220 and 232.

Once the high pressure refrigerant from conduit 220 is fed to compressor 202, shown in FIG. 1A, the pressure in conduit 221 drops and second spring 246 starts exerting force on piston 242 to move from the second position to the first position. Second pad 258 holds second junction 254 in place while piston 242 is intermediate between the second and the first position. Once piston 242 arrives at the first position, it exerts a magnetic pull on first junction 252 thereby snapping first junction 252 of rocker arm 250 against first pad 256 and the cycle is then repeated.

If energy efficiency and cost are primary concerns, compressor unit 202 should be a single stage compressor. By utilizing a plurality of evaporators selected to operate at desired respective refrigeration temperatures, improved energy use at minimum cost is achieved.

The refrigeration system illustrated in FIG. 1A requires less energy than a single-evaporator, single-compressor circuit with the same cooling capacity. Some efficiency advantages come about due to the fact that the vapor leaving the higher temperature evaporator 208 is compressed from an intermediate pressure, rather than from the lower pressure of the vapor leaving the lower temperature evaporator 224. Since the vapor from phase separator 210 is at a higher pressure than the vapor from freezer evaporator 224, the pressure ratio is lower and less compression work is required when the vapor from phase separator 210 is compressed to the desired compressor outlet pressure than when that from the lower temperature evaporator 224 is compressed.

Figure 2:
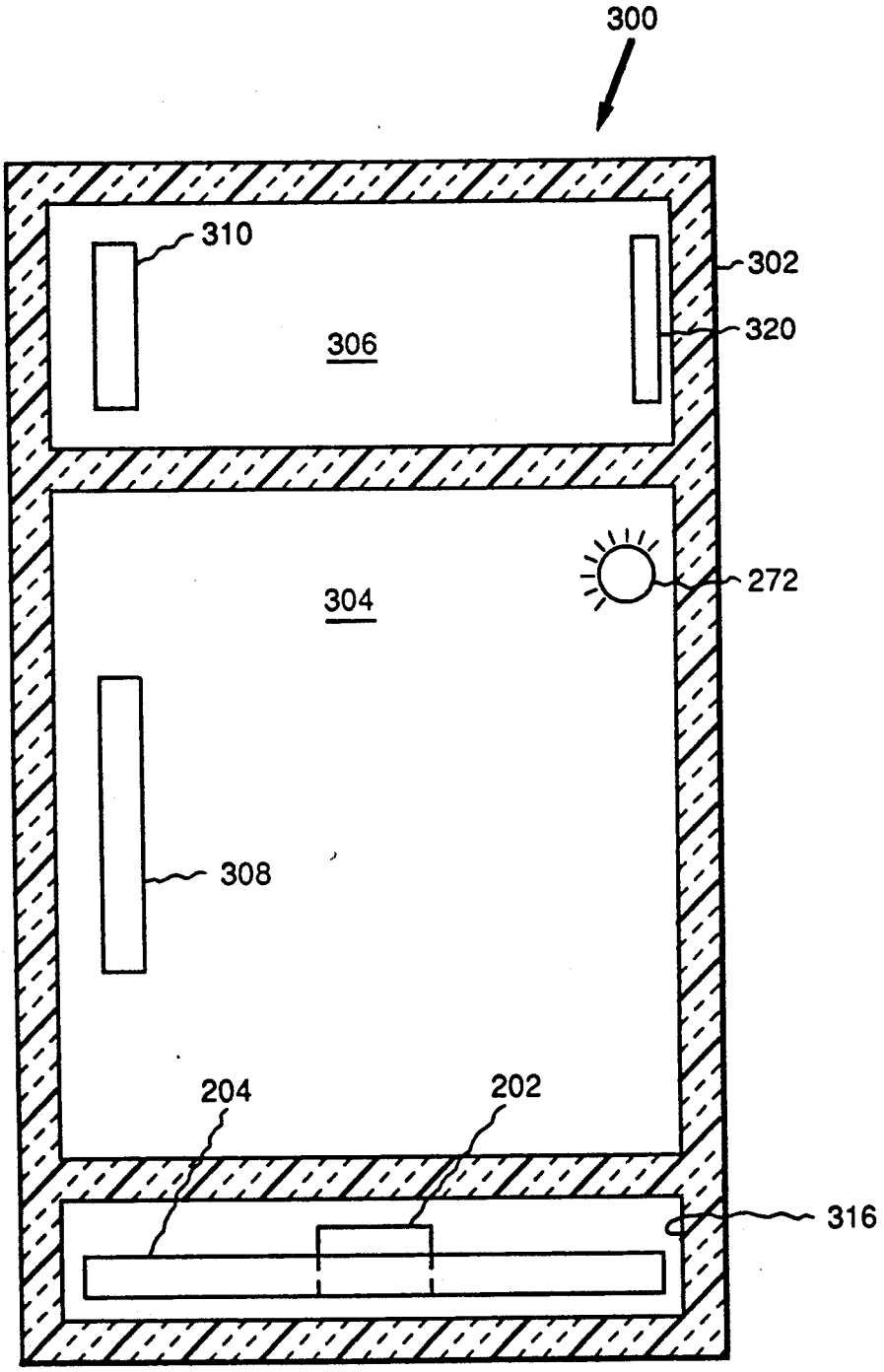
FIG. 2 is a block diagram illustrating a household refrigerator incorporating a refrigeration system having a fresh food evaporator and a freezer evaporator.

FIG. 2 is a block diagram illustration of a household refrigerator 300 including an insulated wall 302 forming fresh food compartment 304, discussed earlier, and a freezer compartment 306. FIG. 2 is provided for illustrative purposes only, particularly to show one apparatus which has separate compartments which require refrigeration at different temperatures. In the household refrigerator, fresh food compartment 304 and freezer compartment 306 are typically maintained from about +1° to about +8° and from about −25° to about −10° C., respectively.

In accordance with the present invention, a first evaporator 308 (high pressure evaporator) is located in the fresh food compartment 304 and a second evaporator 310 (low pressure evaporator) in freezer compartment 306. The invention is not limited to the physical location of the evaporators and the location shown in FIG. 2 is only for illustrative purposes. Said evaporators could be located anywhere in or even outside the refrigerator, and the cooled air from each evaporator directed to the appropriate compartments via conduits, barriers and the like.

First and second evaporators 308 and 310 are driven by compressor unit 202 and condenser 204 shown located in a compressor/condenser compartment 316. Control knob 272 is located in fresh food compartment 304 and a temperature sensor 320 in freezer compartment 306. Control knob 272 adjusts via linking means, such as flexible cable 268 shown in FIGS. 1B and 1C, the position of rocker arm chamber 248 with respect to piston housing 219, shown in FIGS. 1B and 1C, thus controlling the temperature in compartment 304. Temperature sensor 320 sends a signal, according to its setting, to compressor 202 to run or to stop. First evaporator 308 is typically operated from about −10° to about 0° C. and second evaporator 310 from about −35° to about −15° C., thus maintaining the fresh food and freezer compartments within the aforementioned temperature ranges.

In operation, and by way of example, control knob 272 of a typical household refrigerator of 0.54 $m.^3$ capacity is coupled to a refrigerant flow switching device of the present invention (not shown in FIG. 3). When control knob 272 is set, for example, at +3° C. in fresh food compartment 304, that setting corresponds to a refrigerant temperature of about −4° C. and pressure of about 3.2 $kg./cm.^2$ absolute in first evaporator 308. As compressor unit 202 evacuates first evaporator 308, part of the refrigerant present in evaporator 308 boils and thereby lowers the pressure and the temperature of the refrigerant present in first evaporator 308 to about 2.5 $kg./cm.^2$ absolute and about −6° C., respectively.

During a typical cycle of about 21 seconds under the aforedescribed exemplary refrigerator conditions, the high pressure refrigerant from evaporator 308 is transported to compressor unit 202 by valve 218 for about 5 seconds and the low pressure refrigerant form evaporator 310 is transported to compresor unit 202 by valve 218 for about 16 seconds. The allocation of conveying time between the high pressure and the low pressure refrigerant to compressor unit 202 is a function of the cooling capacity of first evaporator 308 and second evaporator 310. The capacity ratio between first evaporator 308 and second evaporator 310 for the aforedescribed refrigerator is generally about 3:1. Said capacity ratio is defined as the ratio of the heat removing capacity in kcal. per hour of first evaporator 308 to that of second evaporator 310. Thus, in the aforementioned example first evaporator 308 removes heat from its compartment at about three times the rate of second evaporator 310. Cycling of valve 218 continues until the temperature set on thermostat 320 in freezer compartment 306 is reached; at that time, compressor unit 202 shuts down until a further demand signal from thermostat 320 is received.

Control knob 272 and sensor 320 are preferably user adjustable so that the user selects a temperature, or temperature range, at which each evaporator is to be activated and inactivated. In this manner, operation of the refrigerant flow switching device is adjusted by the user.

As shown in FIG. 2, the illustrative refrigeration system includes two evaporators which are selected to operate at desired refrigeration temperatures. However, the invention can also employ more than two evaporators. Reduced energy use is provided by utilizing a plurality of evaporators.

It is contemplated that in some refrigeration systems, all of the energy efficiencies and reduced costs provided by the present invention may not be strictly necessary. Thus, the invention may be modified to vary efficiency and costs relative to the described embodiments. For example, a plurality of compressors or a compressor having a plurality of stages, or any combination thereof, may be utilized. It is also contemplated that instead of a single solenoid 278 of valve 218, shown in FIGS. 1B and 1C of the preferred embodiment, a spool having a solenoid at each end, i.e., a double solenoid similar to the one described in the aforementioned application Ser. No. 07/612,290, may be used. Such a system would utilize two independent electrical circuits having two switch assemblies operated by two switch arms positioned on each side of a rocker arm, such as the one shown in FIGS. 1B and 1C.

What is claimed is:

1. A flow switching device for alternately conveying refrigerant from low and high pressure evaporator means to compressor means of a refrigeration system, said device comprising:

a switching valve adapted to move between a low and high pressure position allowing said refrigerant to flow alternately and respectively from said low and high pressure evaporator means to said compressor means; and a pressure switch between said high pressure evaporator means and said low pressure evaporator means, said pressure switch connected to said switching valve and adapted to move said switching valve between said low and high pressure positions and comprising:

a piston housing positioned in a refrigerant flow relationship between said high and low pressure evaporator means, said housing being divided into a first portion and a second portion by a ferrous metal piston slidably positioned therein;

a rocker arm chamber positioned in a slidable relationship with said piston housing and having first and second magnetized junctions mounted on a rocker arm; and a switch assembly electrically connected to said switching valve such that when said piston is in a first position said switch assembly is opened and moves said switching valve to said low pressure position, and when said piston is in a second position said switch assembly is closed and moves said switching valve to said high pressure position.

2. The device of claim 1 wherein said switching valve is solenoid operated.

3. The device of claim 1 wherein said switching valve comprises a spool slidably positioned in a valve housing and a first biasing means mounted on said spool to cyclically align a groove on said spool in said low and high pressure positions.

4. The device of claim 3 wherein said first biasing means is a compression spring.

5. The device of claim 1 wherein said switch further comprises timing adjustment means for adjusting cyclical timing of moving said switching valve between said low and high pressure positions in accordance with a predetermined temperature range of said high pressure evaporator means.

6. The device of claim 1 wherein said switch further comprises second biasing means positioned in said first portion of said piston housing to urge said piston to said first position when said solenoid is deenergized.

7. The device of claim 1 wherein said switch further comprises timing adjustment means for adjusting cyclical timing of moving said switching valve between said low and high pressure positions in accordance with a predetermined range of temperatures of said high pressure evaporator means, said timing adjustment means comprising an adjustable member affixed to said rocker arm chamber to slide said chamber against said piston housing in accordance with said predetermined range of temperatures.

8. The device of claim 7 wherein said timing adjustment means is user adjustable.

9. The device of claim 6 wherein when said piston is in said first position said first junction is held against the wall of said chamber by the magnetic attraction between said piston and said first junction and when said piston is in said second position said second junction is held against the wall of said chamber by the magnetic attraction between said piston and said second junction.

10. The device of claim 9 further comprising magnetic first and second pads affixed on the wall of said rocker arm chamber and positioned in an opposing relationship with said first and second junctions, respectively, for preventing movement of said rocker arm during the time when said piston moves from said first position to said second position and vice versa.

11. The device of claim 6 wherein said switch assembly comprises a stationary contact and a movable switch contact mounted on a switch arm affixed to said rocker arm such that when said switch assembly is closed said movable switch contact connects with said stationary switch contact to energize said solenoid, and when said switch assembly is open said movable switch contact disconnects from said stationary switch contact to deenergize said solenoid.

12. A refrigerant flow switching device for alternately conveying refrigerant from either high pressure or low pressure evaporator means to compressor means of a refrigeration system, said device comprising:

a solenoid operated refrigerant flow switching valve positioned in refrigerant flow relationship with said high pressure evaporator means, such that when said solenoid is deenergized said valve allows said refrigerant to flow from said low pressure evaporator means to said compressor means and when said solenoid is energized said valve allows said refrigerant to flow from said high pressure evaporator means to said compressor means; and a pressure switch comprising a piston housing positioned in a refrigerant flow relationship between said high pressure evaporator means and said low pressure evaporator means, said housing being divided into first and second portions by a ferrous metal piston slidably positioned therein, said first portion having a first biasing means positioned therein, said pressure switch further comprising a rocker arm chamber positioned in a slidable relationship with said piston housing, said rocker arm chamber having first and second magnetized junctions mounted on a rocker arm and a switch assembly connected to said electrical power supply such that when said piston is in a first position said switch assembly is opened to deenergize said solenoid and when said piston is in a second position said switch assembly is closed to energize said solenoid.

13. The device of claim 12 wherein said switch further comprises timing adjustment means for adjusting cyclical timing of said energizing and deenergizing of said solenoid in accordance with a predetermined range of temperatures of said low pressure evaporator means, said timing adjustment means comprising an adjustable member affixed to said rocker arm chamber to move said chamber against said piston housing in accordance with said predetermined range of temperatures of said low pressure evaporator means.

14. A refrigerator, comprising:

compressor means;

condenser means connected to receive refrigerant discharged from said compressor means;

a fresh food compartment;

first evaporator means for refrigerating said fresh food compartment and connected to receive at least part of the refrigerant discharged from said condenser means;

a freezer compartment;

second evaporator means for refrigerating said freezer compartment and connected to receive at least part of the refrigerant discharged from said condenser means; and a refrigerant flow switching device for alternately conveying refrigerant from either high pressure or low pressure evaporator means to compressor means of a refrigeration system, said switching device comprising:

a switching valve adapted to move between a low and high pressure position allowing said refrigerant to flow alternately and respectively from said low and high pressure evaporator means to said compressor means; and a pressure switch between said high pressure evaporator means and said low pressure evaporator means, said pressure switch connected to said switching valve and adapted to move said switching valve between said low and high pressure positions and comprising:

a piston housing positioned in a refrigerant flow relationship between said high and low pressure evaporator means, said housing being divided into a first portion and a second portion by a ferrous metal piston slidably positioned therein;

a rocker arm chamber positioned in a slidable relationship with said piston housing and having first and second magnetized junctions mounted on a rocker arm; and a switch assembly electrically connected to said switching valve such that when said piston is in a first position said switch assembly is opened and moves said switching valve to said low pressure position, and when said piston is in a second position said switch assembly is closed and moves said switching valve to said high pressure position.

15. The refrigerator in accordance with claim 14 wherein said switching valve is solenoid operated.

16. The refrigerator in accordance with claim 14 wherein operation of said pressure switch is user adjustable.

17. The refrigerator in accordance with claim 14 wherein said first and second evaporator means are effective to maintain said fresh food and freezer compartments from about +1° to about +8° C. and from about −25° to about −10° C., respectively.

* * * * *